US005181628A

United States Patent [19]

Okezie

[11] Patent Number: 5,181,628

[45] Date of Patent: Jan. 26, 1993

[54] WASTE RECEPTACLE LINER BAG

[76] Inventor: Alozie C. Okezie, 624 Packard, Apt. #2, Ann Arbor, Mich. 48104

[21] Appl. No.: 831,407

[22] Filed: Feb. 5, 1992

[51] Int. Cl.[5] ..... B65D 25/16; B65D 30/10; B65D 33/14

[52] U.S. Cl. ..... 220/404; 383/22; 383/66

[58] Field of Search ..... 220/403, 404; 383/22, 383/66

[56] References Cited

U.S. PATENT DOCUMENTS

| | | | |
|---|---|---|---|
| 816,989 | 4/1906 | Moler et al. . | |
| 1,124,925 | 1/1915 | Low . | |
| 1,369,448 | 2/1921 | McNab | 383/66 |
| 1,478,884 | 12/1923 | Becker . | |
| 2,761,481 | 9/1956 | Boatwright | 383/22 |
| 3,762,627 | 10/1973 | Ross, Jr. et al. | 229/37 R |
| 3,951,284 | 4/1976 | Fell et al. | 220/404 |
| 3,964,630 | 6/1976 | Getz | 220/63 R |
| 4,356,933 | 11/1982 | Connolly | 220/404 |
| 4,461,402 | 7/1984 | Fell et al. | 220/403 |
| 4,674,127 | 6/1987 | Yamada et al. | 220/404 |
| 4,784,287 | 11/1988 | Yamada et al. | 220/403 |
| 4,792,239 | 12/1988 | Hamada et al. | 220/403 |
| 4,825,596 | 10/1989 | Lohse | 220/403 |
| 4,877,281 | 10/1989 | Altmann | 220/404 |
| 4,913,308 | 4/1990 | Culbertson | 220/404 |
| 4,917,263 | 4/1990 | Korb | 220/404 |
| 5,012,963 | 5/1991 | Rosenbaum | 383/22 |
| 5,022,548 | 6/1991 | Stakis | 220/23.83 |

*Primary Examiner*—Stephen P. Garbe
*Attorney, Agent, or Firm*—Basile and Hanlon

[57] ABSTRACT

A liner bag for a large waste receptacle having a box-like shape with at least one access opening formed in a front wall. The liner bag includes a bottom wall, a pair of side walls, and a back wall, the side walls and the back wall having equal lengths, and a short front wall having a length shorter than the length of the side walls. An opening is formed in the liner bag between the upper edge of the front wall, the portions of the side walls extending above the upper edge of the front wall and the back wall coincident with the access opening and open top end of the waste receptacle. Straps are formed on certain of the side walls and the back wall and extend loosely away from the side and back wall for supporting the liner bag in the waste receptacle and to assist in removal of the liner bag from the waste receptacle.

4 Claims, 2 Drawing Sheets

WASTE RECEPTACLE LINER BAG

BACKGROUND OF THE INVENTION

1. Field of the Invention

The present invention relates, in general, to waste receptacles and, more specifically, to liner bags for waste receptacles.

2. Background Description

Waste receptacles, such as rubbish or trash containers and waste baskets are commonly lined with a disposable plastic liner bag to protect the interior of such receptacles from contact with liquid or solid waste and to simplify the collection and removal of such waste from such receptacles. Such liner bags are provided in a variety of different sizes ranging from small waste basket size up to 33 gallon container size for use with different size waste receptacles.

Typically, such liner bags have a flat, two-sheet construction wherein the two sheets are sealed at both side edges and the bottom edges while leaving an open top end for insertion of waste into the interior of the liner bag. The top end of such liner bags are usually stretched over the top rim of the waste receptacle to support the liner bag in the receptacle in an open, waste receiving position. When full, the top end of the liner bag is brought together and tied with a twist tie or other closure, either before or after the liner bag is removed from the waste receptacle.

Such liner bags are also used to receive biological and other waste, either liquid or solid, generated in hospitals, nursing homes, doctors' offices, etc. It is also known to employ such liner bags in separate receptacles for sorting hazardous biological waste from non-biological waste.

In a large scale waste collection system employed in a hospital, conventional liner bags are used in small waste receptacles in each patient's room or in a predetermined area of the hospital to collect biological and other waste products, such as food, paper, human blood and waste, etc. A large waste receptacle is used to collect all of the smaller bags for a predetermined area, such as a single floor of a hospital, a ward, etc. The large receptacle, such as one sold by American Pharmaseal Company, has a box-like construction mounted on a wheeled, legged frame. The receptacle includes a back wall and two spaced side walls which are joined to and extend from a planar base. The side walls and the back wall have a height of approximately 5½ to 6 feet and extend upward from the base to an open top end. A solid front wall extends across the opposed side walls and is joined to the side walls and the base. The front wall extends upward for a predetermined height from the base to an upper edge located intermediate the height of the side walls. At least one and preferably two spaced access openings are formed in the receptacle above the upper edge of the front wall and between the opposed side walls to enable waste to be deposited in the interior of the receptacle. Doors are pivotally mounted to the receptacle for closing the access openings.

An automated robot carrier is used to transport each large receptacle, on demand or on a time schedule, from the collection area to a central disposal site. At the central disposal site, the individual small waste bags in the large receptacle are removed and properly disposed of. However, it is common for spillage to occur from the small bags, either due to a loosening of the tie fasteners on the bags or a puncturing of the bags due to sharp objects, such a needles, etc., in the smaller bags. This results in the accumulation of liquid and/or solid material in the bottom of the large receptacle after the smaller liner bags have been removed from the receptacle. The liquids congeal and dry on the inner surfaces of the receptacle thereby necessitating scraping and the use of caustic chemicals to remove such dried liquids from the container to clean and sterilize the receptacle.

Such cleaning of the large waste receptacle is a time consuming, hazardous task due to the existence of biological waste encountered in a hospital. The caustic chemical typically employed to clean the interior of such waste receptacles requires careful handling and the need for protective equipment, such as protective suits, boots, gloves and a mask for the person assigned to cleaning the receptacle. Thus, the cleaning person can be potentially exposed to hazardous biological waste during the cleaning process. The protective equipment and the time required to remove dried or fluid liquid and solid material from the large receptacle increases the cost of the waste disposal process and, also, increases the turn around time between uses of the waste receptacle thereby delaying its return to use or requiring additional receptacles in the waste removal system.

Thus, it would be desirable to provide a liner bag for a large waste receptacle, such as one typically used in a hospital to collect small waste liner bags from a predetermined area, which overcomes the problems encountered in the use of such large waste receptacles. It would also be desirable to provide a liner bag for a large waste receptacle which collects spillage, either liquid or solid, from the smaller liner bags deposited in the large waste receptacle and which prevents such waste from contacting the interior walls of the large waste receptacle. It would also be desirable to provide a liner bag for a large waste receptacle which is easy to install and remove from the waste receptacle. It would also be desirable to provide a liner bag for a large waste receptacle which minimizes contact and/or exposure with the hazardous or biological waste generated in a hospital waste collection system.

SUMMARY OF THE INVENTION

The present invention is a liner bag for a large waste receptacle, such as a waste receptacle used on a hospital waste collection system for collecting biological and non-biological waste.

The liner bag comprises a unitary, flexible container having a box-like shape formed of a bottom wall, opposed side walls extending from the bottom wall and a back wall extending from the bottom wall and joined to the side walls. A front wall also extends from the bottom wall to an upper edge intermediate the height of the side walls. The liner bag fits in registry with at least certain of the interior walls of a large waste receptacle having a bottom wall, opposed side walls, a back wall and a short front wall joined together in a box-like container shape. Access openings are formed in such a large waste receptacle between the side walls and above the shorter front wall to provide access to the interior of the receptacle.

A plurality of straps are joined to or formed with the liner bag, typically at the upper ends of the side walls and/or the back wall, to support the liner bag in position within the interior of the waste receptacle and to facilitate removal of the liner bag from the waste receptacle after most of the smaller waste containers and loose waste materials have been removed from the liner bag.

In one embodiment, the liner bag has a width dimension for the front wall, the bottom wall and the back wall which is substantially the same a the width dimension of the large waste receptacle such that the front wall, bottom wall, back wall and the opposed side walls of the liner bag are disposed in registry with the corresponding walls of the waste receptacle to completely cover such walls of the waste receptacle. In another embodiment, the width of the liner bag is selected to be approximately one half of the width of the waste receptacle such that two identically constructed liner bags may be disposed side-by-side within the interior of the large waste receptacle. Both liner bags are identically constructed as the larger liner bag and include an access opening extending from the upper edge of the front wall, the portions of the side walls extending upward from the upper edge of the front wall and the back wall to enable waste to be deposited in the interior of the liner bag and the large waste receptacle.

The liner bag of the present invention overcomes many of the problems encountered with the use of large waste receptacles for collecting biological and non-biological waste, such as those employed in a hospital waste collection system. The liner bag protects the interior walls of the large waste receptacle and collects any liquid or solid waste which may spill from the smaller bags deposited in the waste receptacle. This prevents such liquid and/or solid waste from adhering to the interior walls of the waste receptacle which has heretofore required a time consuming and hazardous cleaning operation using caustic chemicals. The liner bag enables such liquid and solid waste material to be easily removed from the waste receptacle without contacting the interior walls of the waste receptacle. The liner bag of the present invention is simple in construction and is easy to employ.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Before describing in detail the construction of the liner bag of the present invention, a brief description of a large waste receptacle in which the liner bag of the present invention can be advantageously used, will first be provided.

Figure 1:
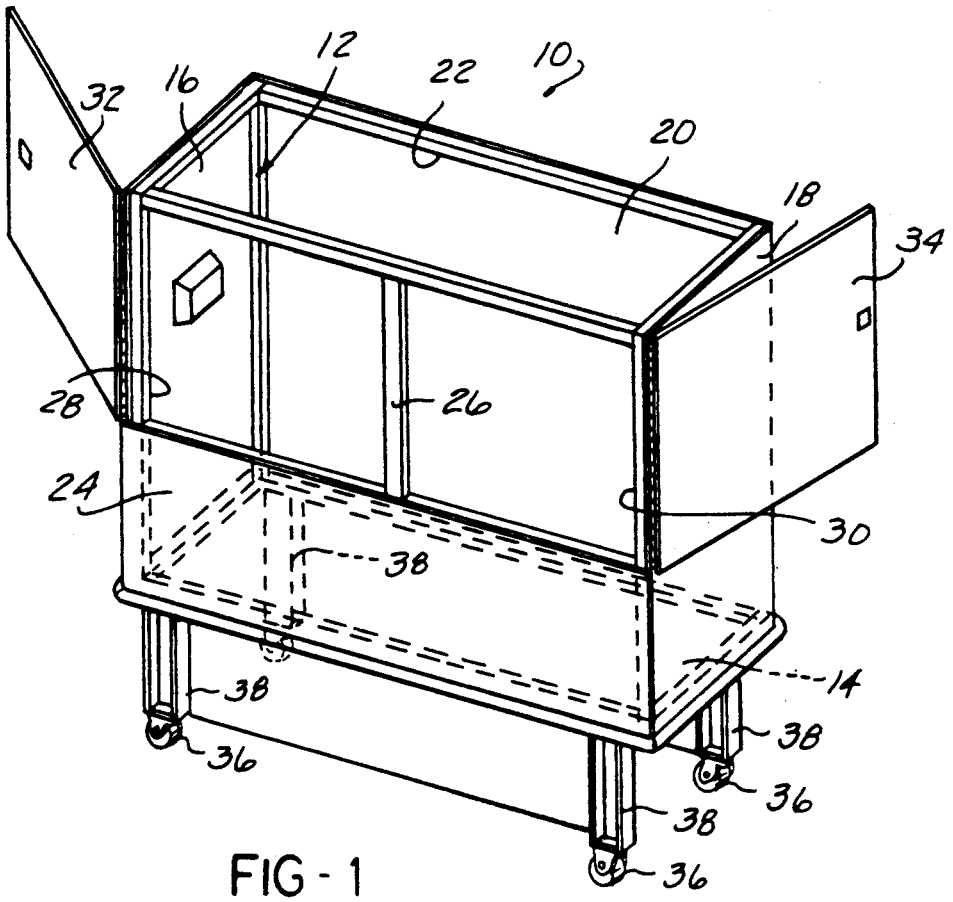
FIG. 1 is a perspective view of a large waste receptacle employed in a hospital waste collection system.

As shown in FIG. 1, a large waste receptacle 10, such as one employed in a hospital waste collection system and manufactured by American Pharmaseal Company, American Hospital Supply Corp., Valencia, Ca. The receptacle 10 includes an interior frame, generally denoted by reference number 12, formed of a number of tubular members joined together in a generally cubical, container-like shape. A planar bottom wall 14 is joined to the bottom of the frame 12. A pair of opposed side walls 16 and 18 are joined to the sides of the frame 12 and extend upward from the bottom wall 14 for a predetermined height. A planar back wall 20 is also joined to the frame 12 and extends upward from the bottom wall 14 between the side walls 16 and 18. The side walls 16 and 18 and the back wall 20 are joined to the frame 12 and to each other by suitable means, such as by welding, to form a unitary receptacle.

The side walls 16 and 18 and the back wall 20 have the same height such that a second or upper end of each of the side walls 16 and 18 and the back wall 20 are in flush alignment at the upper end of the frame 12 to form an open top end 22 for the waste receptacle 10.

A short front wall 24 is joined to the frame 12 at one edge of the bottom wall 14 and between the side walls 16 and 18. The front wall 24 has a shorter height than the height of the side walls 16 and 18. In conjunction with a central tubular member 26 of the frame 12, the front wall 24 and the upper portions of the side walls 16 and 18 form a pair of access openings 28 and 30 which open into the interior of the waste receptacle 10 and allow waste to be deposited in the interior of the waste receptacle 10. The front wall 24 is in the form of a planar sheet which is joined to the frame 12 or to the edges of the side walls 16 and 18 and one edge of the bottom wall 14 by suitable means, such as by welding.

The bottom wall 14, the side walls 16 and 18, the back wall 20 and the front wall 24 are formed of a metallic material, such as aluminum, stainless steel, etc., suitable for hospital use.

A pair of doors 32 and 34 are pivotally mounted by means of hinges to the frame 12 on opposite edges of the access openings 28 and 30. The doors 32 and 34, which are provided with handles, enable the access openings 28 and 30 to be opened and closed, as needed, during use of the waste receptacle 10, as described hereafter.

A plurality of wheels 36 are mounted on legs 38 which depend from the bottom portion of the frame 12. The legs 38 and wheels 36 support the frame 12 and enable the waste receptacle 10 to be transported from a use site to a central disposal site.

As shown in FIG. 1, the legs 38 and wheels 36 are spaced apart in two pairs to provide an opening therebetween for entry of an automated robot controlled carrier, such as one sold by American Pharmaseal Company, underneath the waste receptacle 10 for transporting the waste receptacle 10 between a use site and a disposal site. Alternately the waste receptacle 10 could be manually pushed between the use and disposal sites.

In use, an empty waste receptacle 10 is moved to a desired use site, such as on one floor of a hospital or in one large area, such as a hospital ward. Individual garbage bags from waste receptacles in patients' rooms, for example, are removed from the patients' rooms and deposited in the interior of the waste receptacle 10. When the waste receptacle 10 is full or on a time schedule, the automated carrier will move to and engage the receptacle 10 and transport it to a central disposal site. At the disposal site, the individual small waste bags or containers are manually removed from the large waste receptacle 10 either through the access openings 28 and 30 or through the open top end 22 of the waste receptacle 10. Any spillage of liquid or solid waste from such small waste bags which accumulates in the bottom of the waste receptacle 10 must then be manually removed from the waste receptacle 10 and the interior of the waste receptacle 10 cleaned, typically by use of a caustic chemical.

Figure 2:
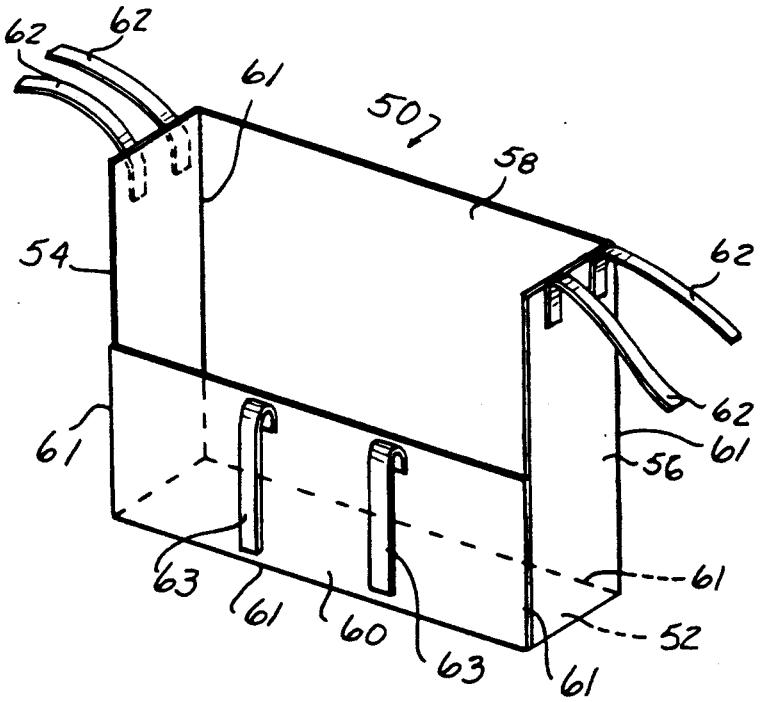
FIG. 2 is a perspective view of a first embodiment of the liner bag of the present invention which is mountable in the waste receptacle shown in FIG. 1.

According to the present invention, a liner bag 50, shown in FIG. 2, is removably emplaceable in the interior of the waste receptacle 10 to protect the interior walls of the waste receptacle 10 from contact with any liquid or solid waste which may spill or leak from the individual bags deposited in the waste receptacle 10.

The liner bag 50 is in the form of a container having a bottom wall 52, a pair of opposed side walls 54 and 56, a back wall 58 and a short front wall 60. The side walls 54 and 56 and the back wall 58 have substantially the same length or height and are formed with substantially the same rectangular dimensions as the side walls 16 and 18 and the back wall 20 of the waste receptacle 10 shown in FIG. 1. The front wall 60 has a shorter height than that of the side walls 54 and 56 so as to be disposed in registry with the front wall 24 of the waste receptacle 10; yet allowing the access openings 28 and 30 of the waste receptacle 10 to be open for the deposit of bags o waste into the interior of the liner bag 50 in the waste receptacle 10.

The bottom wall 52, the side walls 54 and 56, the back wall 58 and the front wall 60 may be formed by a variety of construction methods to the desired shape shown in FIG. 2 such that the wall portions of the liner bag 50 smoothly engage the corresponding wall portions of the waste receptacle 10. Thus, the bottom wall 52, the side walls 54 and 56, the back wall 58 and the front wall 60 may be formed of individual, separate panels which are joined together at abutting edges, such as edges 61, by suitable means, such as by heat welding, to form the desired boxlike shape shown in FIG. 2. Alternately, the front wall 60, the bottom wall 52 and the back wall 58 may be formed of a one-piece sheet which is bent to the desired shape and joined to the two separate side wall panels 54 and 56. Alternately, the side walls 54 and 56 and the bottom wall 52 may be formed of a single sheet which is bent to the desired shape and joined to a separate back wall 58 and a separate front wall 60.

A plurality of straps are provided on the liner bag 50 to facilitate mounting of the liner bag 50 in the waste receptacle 10 as well as removal of the liner bag 50 from the waste receptacle 10. By way of example only, four straps each denoted by reference number 62, are provided at the upper end of the side walls 54 and 56 of the liner bag 50. Each strap 62 is in the form of an elongated, flexible member which is integrally formed with the respective side wall 54 or 56 or is joined thereto by heat seaming or other suitable methods. The straps 62 are adapted to be disposed outward through the top end 22 of the waste receptacle 10 when the liner bag 50 is mounted in the waste receptacle 10 and draped over the exterior surfaces of the side walls 16 and 18 of the waste receptacle 10 to support the side walls 54 and 56 and the back wall 58 of the liner bag 50 in the upright position in the waste receptacle 10. Optionally, additional straps 63 may be attached to the upper edges of the front wall 60 to facilitate removal of the front portion of the liner bag 50 from the waste receptacle 10. In normal use, the front wall straps 63 are deployed inside the waste receptacle between the inner surface of the front wall 24 of the waste receptacle 10 and the outer surface of the front wall 60 of the liner bag 50 so as not to interfere with the movement of the doors 32 and 34. The straps 62 and/or 63 may also be tied together to secure any loose waste material which may be left in the bottom of the liner bag 50 after all or most of the small waste bags have been removed therefrom during removal of the liner bag 50 from the waste receptacle 10.

The liner bag 50 is formed of a flexible, lightweight plastic, such as polyethylene, for example. Further, the liner bag 50 is formed of a suitable thickness or ply to resist puncture and tearing during mounting and removal from the waste receptacle 10.

The liner bag 50 may be supported in contact with the walls of the waste receptacle 10 by draping the straps 62 over the outer surfaces of the waste receptacle 10 as described above. The straps 62 can optionally be tied or secured to external projections, not shown, mounted on the outer surfaces of the waste receptacle 10.

Figure 3:
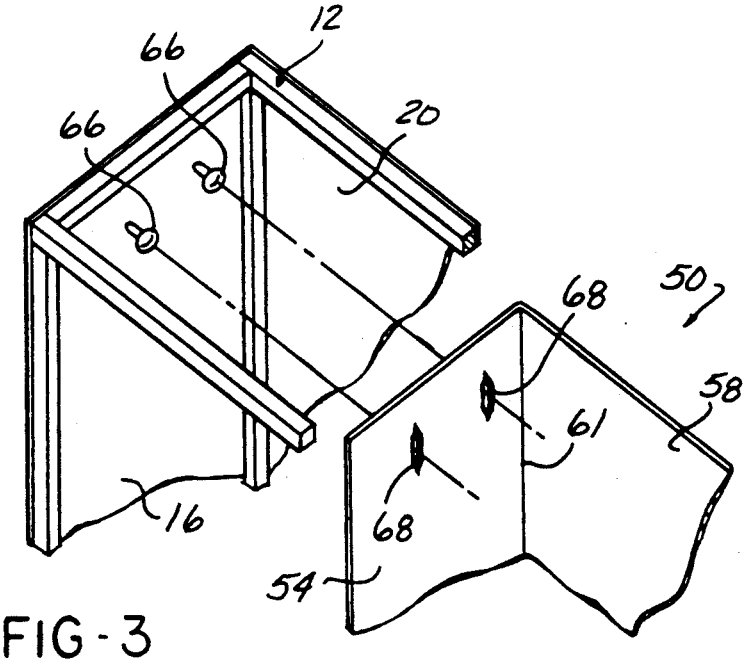
FIG. 3 is a partial, exploded, perspective view of a means for supporting the liner bag in a waste receptacle.

Alternately, as shown in FIG. 3, a liner bag support means in the form of a plurality of projections 66 of any shape, such as spherical balls, hooks, etc., is provided on the upper portions of the inner surfaces of at least the two side walls 16 and 18 and, optionally, on the back wall 20 and the front wall 24. Apertures 68 are formed in the corresponding walls of the liner bag 50 to releasably engage the projections 66 to support the liner bag 50 in the illustrated deployed position within the waste receptacle 10. One or two projections 66 and a like number of apertures 68 may be provided on each wall of the waste receptacle 10 and the liner bag 50, respectively. Further, it will be understood that the projections 66 and mating apertures 68 may be used with or without the straps 62.

In use, a new liner bag 50 is inserted into the interior of a empty waste receptacle 10 and the respective walls thereof smoothly positioned in contact with the corresponding bottom wall 14, side walls 16 and 18, back wall 20 and front wall 24 of the waste receptacle 10 thereby substantially covering all of the interior surfaces of the waste receptacle 10. The optional support means, described above, may be used to support the liner bag 50 in the deployed, open position. Individual small waste bags, as described above, and/or loose waste may then be deposited into the waste receptacle 10 through the top end 22 of the waste receptacle 10 or through the access openings 28 and 30. When the waste receptacle 10 is full or on a time schedule, the waste receptacle 10 is transported or moved to a central disposal site where the individual waste bags are removed from the interior of the waste receptacle 10. When all or substantially all of the individual waste bags have been removed therefrom, the liner bag 50 is then removed from the waste receptacle 10 by grasping the straps 62 and pulling the liner bag 50 from the interior of the waste receptacle 10 either through the open top end 22 or through either of the access openings 28 and 30 in the waste receptacle 10. During such removal, any liquids or solid waste which may have leaked or spilled from the individual waste bags previously deposited in the waste receptacle 10 or any loose waste deposited in the waste receptacle 10 is retained within the liner bag 50. This prevents such waste from contacting the interior walls of the waste receptacle 10 thereby eliminating the need for additional time consuming, expensive and hazardous cleaning operations to remove such spilled or loose waste from the interior of the waste receptacle 10.

Figure 4:
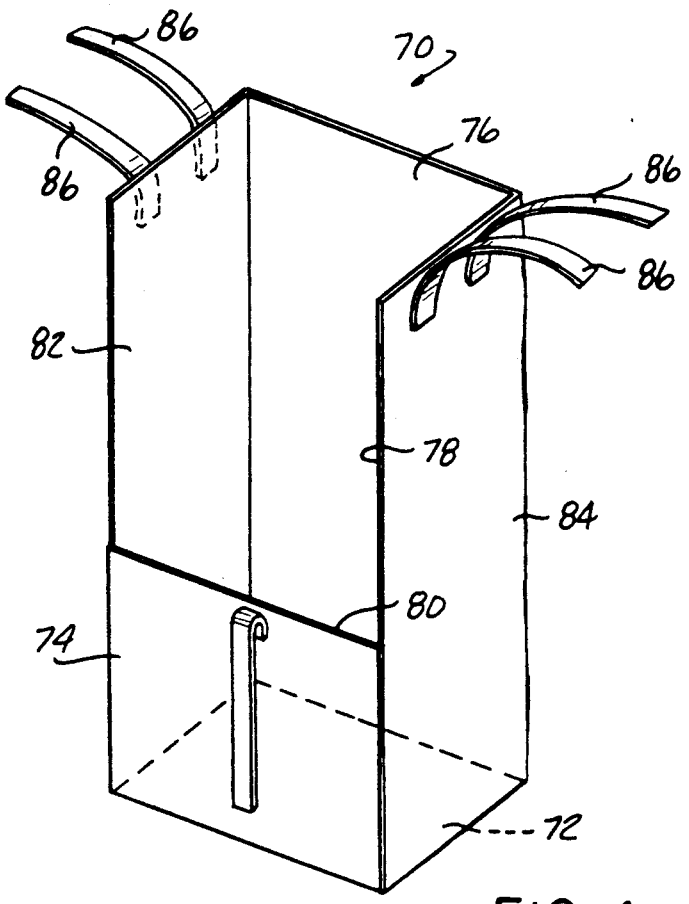
FIG. 4 is a perspective view of a second embodiment of the liner bag of the present invention.

FIG. 4 depicts another embodiment of the liner bag of the present invention. The liner bag 70 shown in FIG. 4 is substantially identically constructed as the liner bag 50 except that the width of the bottom wall 72, the front wall 74 and the back wall 76 is substantially one half the width of such walls in the liner bag 50 and the width of the corresponding wall surfaces in the large waste receptacle 10. This enables two identically constructed liner bags 70 to be mounted side-by-side within the large waste receptacle 10. However, an access opening denoted by reference number 78 is formed between the upper edge 80 of the front wall 74, the portions of the side walls 82 and 84 extending upward from the upper edge 80 of the front wall 74, and the upper edge of the back wall 76 which is coincident with one of the access openings 28 or 30 and the open top end 22 of the large waste receptacle 10. This enables waste, either loose or in small bags, to be deposited within the interior of the liner bag 70. However, the bottom wall 72, the front wall 74, the back wall 76 and one of the side walls 82 and 84 is disposed in registry with and covers the corresponding wall of the large waste receptacle 10 to protect such wall surfaces from contact with loose waste contained within the liner bag 70.

Straps 86 are mounted or formed on the upper ends of the side walls 82 and 84 and extend loosely outward therefrom to support the liner bag 70 in the large waste receptacle 10 and to assist in removal of the liner bag 70 from the waste receptacle 10.

Although not shown, apertures 68 may be provided on some or all of the side wall 82, back wall 76 and front wall 74. The apertures releasably engage internal projections 66 in the interior of the waste receptacle 10 to support the liner bag 70 in the open, deployed position in the waste receptacle 10.

In summary, there has been disclosed a unique liner bag for a large waste receptacle which protects the interior wall portions of the waste receptacle from contact with liquid or solid waste deposited in the large waste receptacle. The liner bag is constructed so as to be disposed in substantial conformity with all of the interior walls of the waste receptacle to completely cover such interior walls. The liner bag is simple in construction for a low manufacturing cost. Further, the liner bag is easily installed in and removed from the large waste receptacle by means of the straps on the liner bag.

The use of the liner bag of the present invention eliminates the costly, time consuming and hazardous cleaning operations previously required to remove any liquid or solid waste which may have leaked or spilled from the individual small waste bags deposited in the large waste receptacle and which accumulated on the bottom or interior wall surfaces of the waste receptacle. When the large waste receptacle is used in a hospital, such waste may include biological materials which pose a substantial hazard to cleaning personnel. The liner bag of the present invention simplifies such cleaning operations and minimizes any exposure to hazardous, biological materials. This eliminates the need for protective equipment for the cleaning personnel as well as the need for caustic chemicals to clean the interior of the waste receptacle.

What is claimed is:

1. In a waste receptacle having a bottom wall, opposed side walls joined to and extending upward from the bottom wall to a top end, a back wall joined to the side walls and the bottom wall and extending upward from the bottom wall to a top end, the back wall and the side walls having identical lengths such that the top ends thereof surround an open top end in the waste receptacle, and a short front wall joined to and extending from the bottom wall to an upper edge intermediate the length of the side walls, the front wall having a height shorter than the height of the side walls to define an access opening in combination with an upper portion of the side walls extending above the upper edge of the front wall into the interior of the waste receptacle, the access opening continuing to the open top end of the waste receptacle, the improvement comprising:

a liner bag in the form of a unitary, flexible container having a bottom wall, a back wall, and opposed side walls, the back wall and the side walls having identical lengths and extending from one end in registry with the bottom wall to opposed spaced, second ends surrounding an open top end of the liner bag, a front wall extending from the bottom wall to an upper end intermediate the length of the side walls to define an opening into the interior of the container between the upper end of the front wall, the portions of the side walls extending upward from the upper edge of the front wall, and the open top end coincident with the access opening and the open top end in the receptacle when the liner bag is mounted in the receptacle;

a plurality of straps attached to at least certain of the side walls and the back wall of the container, for supporting the container in the receptacle and for assisting in the removal of the container from the receptacle; and wherein the bottom wall, the front wall, the back wall and at least one of the side walls of the container are disposed in substantial registry with and cover the bottom wall, the front wall, the back wall and at least one of the opposed side walls, respectively, of the waste receptacle when the liner bag is mounted in the waste receptacle.

2. The improvement of claim 1 wherein the liner bag is formed of a flexible plastic material.

3. The improvement of claim 1 wherein the straps comprises elongated strip member mounted at the second ends of at least certain of the side walls and the portions of the back wall adjacent the second ends of the side walls and loosely extending therefrom.

4. The improvement of claim 1 wherein the width of the front wall, the bottom wall and the back wall are each substantially equal to the width of the waste receptacle.

* * * * *